US007043864B1

(12) United States Patent
Reed

(10) Patent No.: US 7,043,864 B1
(45) Date of Patent: May 16, 2006

(54) SPEAR GUN SIGHT ASSEMBLY

(76) Inventor: Mark A. Reed, 228 5th St., P.O. Box 281, Iota, LA (US) 70543

( * ) Notice: Subject to any disclaimer, the term of this patent is extended or adjusted under 35 U.S.C. 154(b) by 69 days.

(21) Appl. No.: 10/960,841

(22) Filed: Oct. 8, 2004

(51) Int. Cl.
*F41G 1/00* (2006.01)
*F41G 1/02* (2006.01)
*F41G 1/06* (2006.01)

(52) U.S. Cl. ..... 42/111; 42/124; 42/1.14

(58) Field of Classification Search ..... 42/1.14, 42/105, 111, 113, 124, 135, 140–144, 148; 33/265; D22/109, 110
See application file for complete search history.

(56) References Cited

U.S. PATENT DOCUMENTS

| | | | | | |
|---|---|---|---|---|---|
| 2,645,017 | A | * | 7/1953 | Haase | 42/111 |
| 2,795,048 | A | * | 6/1957 | Seymour et al. | 42/148 |
| 2,814,284 | A | * | 11/1957 | Sileo | 124/25 |
| 3,484,665 | A | * | 12/1969 | Mountjoy et al. | 361/232 |
| 4,044,486 | A | | 8/1977 | Van Holten | |
| 4,055,000 | A | | 10/1977 | Cesin | |
| D260,113 | S | | 8/1981 | Ross | |
| 4,418,487 | A | | 12/1983 | Strahan | |
| D293,460 | S | * | 12/1987 | Williams | D22/109 |
| 4,790,075 | A | * | 12/1988 | Howard, Sr. | 42/130 |
| 4,841,659 | A | * | 6/1989 | Williams | 42/124 |
| 5,428,915 | A | | 7/1995 | King | |
| 5,442,863 | A | * | 8/1995 | Fazely | 33/265 |
| D382,038 | S | * | 8/1997 | Nigh | D22/109 |
| 5,680,725 | A | | 10/1997 | Bell | |
| 5,926,964 | A | | 7/1999 | Korapaty | |
| D428,962 | S | * | 8/2000 | Morford | D22/108 |
| 6,336,285 | B1 | * | 1/2002 | Baumer | 42/124 |
| 2004/0211105 | A1 | * | 10/2004 | Arachequesne | 42/113 |

FOREIGN PATENT DOCUMENTS

| | | | |
|---|---|---|---|
| CH | 666 343 | A * | 7/1988 |

* cited by examiner

*Primary Examiner*—Michael J. Carone
*Assistant Examiner*—Bret Hayes

(57) ABSTRACT

A spear gun sight assembly includes a rear sight with a first plate having a generally perpendicular bend therein such that a vertically orientated lower portion and a horizontally orientated upper portion are defined. A peep sight is attached to and extends upwardly from a top side of the upper portion. The peep sight has a peephole extending therethrough. A first coupler is adapted for releasably securing the rear sight to a spear gun. A front sight includes a second plate that has an inner side and an outer side. A loop is attached to the second plate so that the loop extends away from the inner side. A sight pin is attached to the second plate and extends into the loop. A second coupler is adapted for releasably securing the front sight to the spear gun so that the peephole is aligned with the sight pin.

5 Claims, 3 Drawing Sheets

SPEAR GUN SIGHT ASSEMBLY

BACKGROUND OF THE INVENTION

1. Field of the Invention

The present invention relates to gun sight assemblies and more particularly pertains to a new gun sight assembly for removable attachment to a spear gun.

2. Description of the Prior Art

The use of gun sight assemblies is known in the prior art. U.S. Pat. No. 4,055,000 describes a device specifically designed for providing a sight for a spear gun. Another type of gun sight assembly is U.S. Pat. No. 4,044,486 which in particular describes a mounting assembly for mounting a scope onto a gun, such as a rifle. Another sight mount for mounting a scope onto a gun is shown in U.S. Pat. No. Des. 260,113. Yet another such mounting is shown in U.S. Pat. No. 4,418,487.

While these devices fulfill their respective, particular objectives and requirements, the need remains for a device that allow for the mounting of a sight, and more particularly a bow sight, to a spear gun. A conventional bow sight includes a large loop having sight pins mounted therein. Such a sight is more readily visible under water than smaller sights that are typically used on guns. The above mounts, however, are not well suited for being used on a spear gun. For these reasons, a new mounting is need, which will allow for easy retrofitting of a bow sight onto a spear gun.

SUMMARY OF THE INVENTION

To this end, the present invention generally comprises a rear sight that includes a first plate having a generally perpendicular bend therein so that the first plate includes a vertically orientated lower portion and a horizontally orientated upper portion. The lower portion has a first side and a second side. A peep sight is attached to and extends upwardly from a top side of the upper portion. The peep sight has a peephole extending therethrough. A first coupler is adapted for releasably securing the rear sight to a spear gun. A front sight includes a second plate that has an inner side and an outer side. A loop is attached to the second plate so that the loop extends away from the inner side. A sight pin is attached to the second plate and extends into the loop. A second coupler is adapted for releasably securing the front sight to the spear gun so that the peephole is aligned with the sight pin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
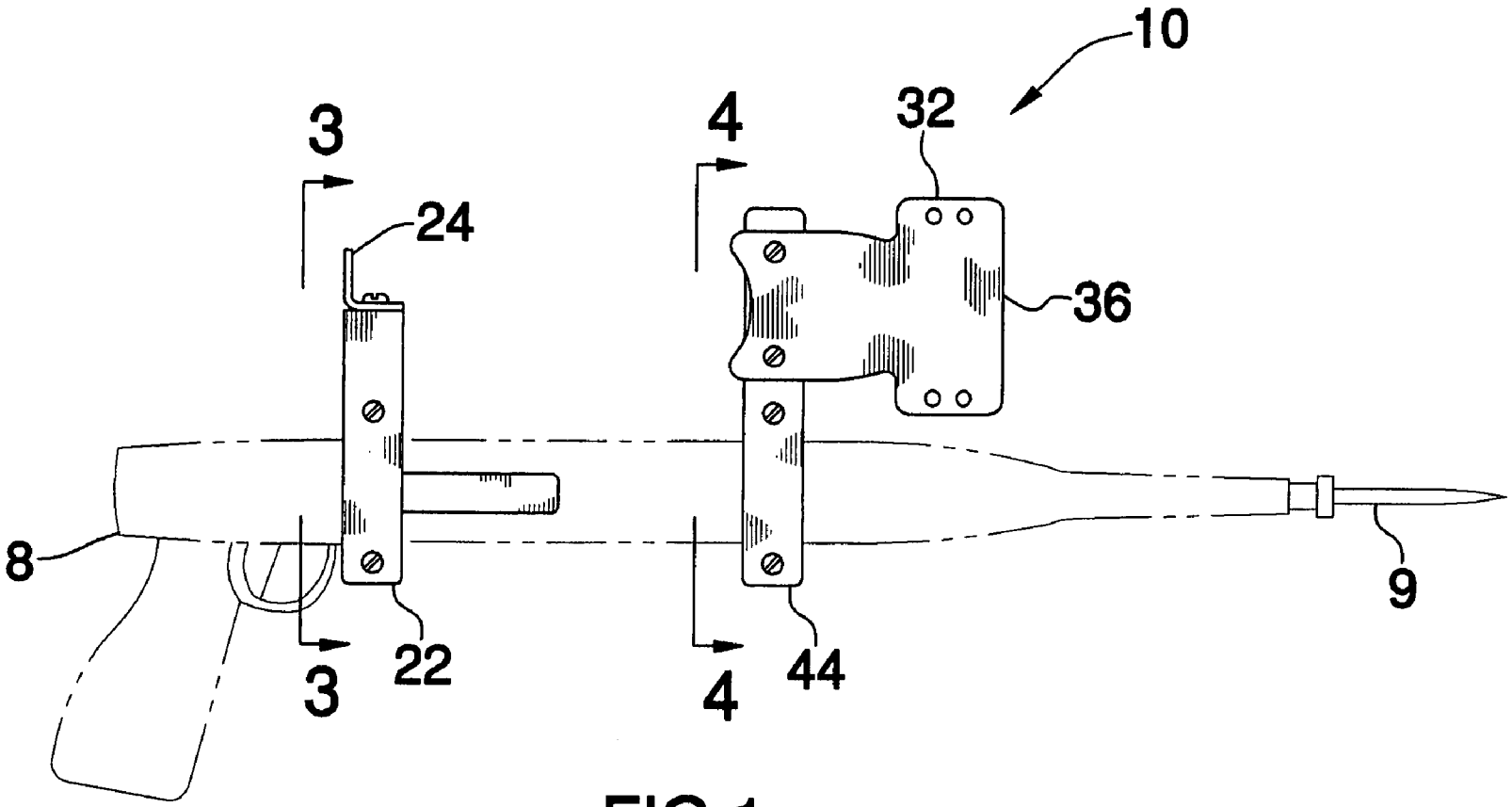
FIG. 1 is a right side view of a spear gun sight assembly according to the present invention.
Figure 2:
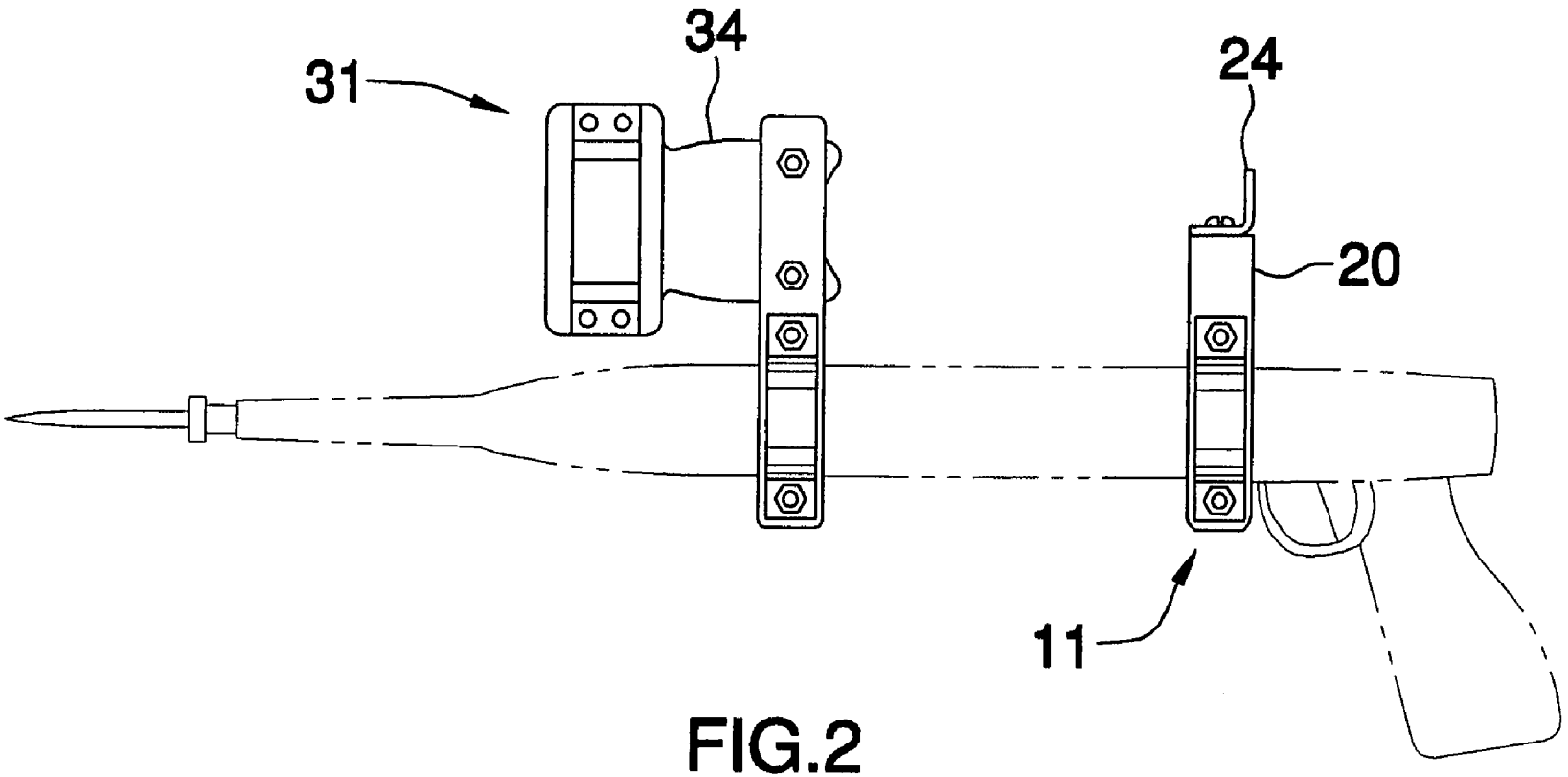
FIG. 2 is a left side view of the present invention.
Figure 4:
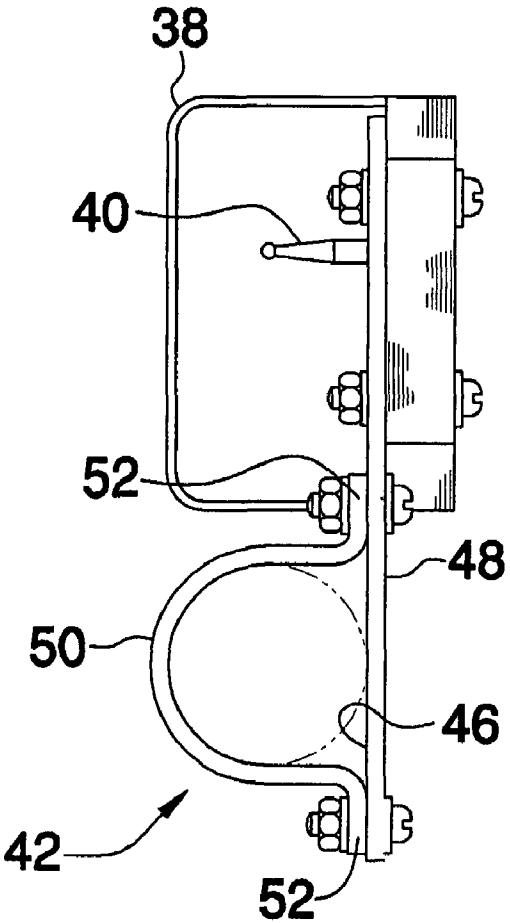
FIG. 4 is a rear view of a front sight of the present invention.
Figure 3:
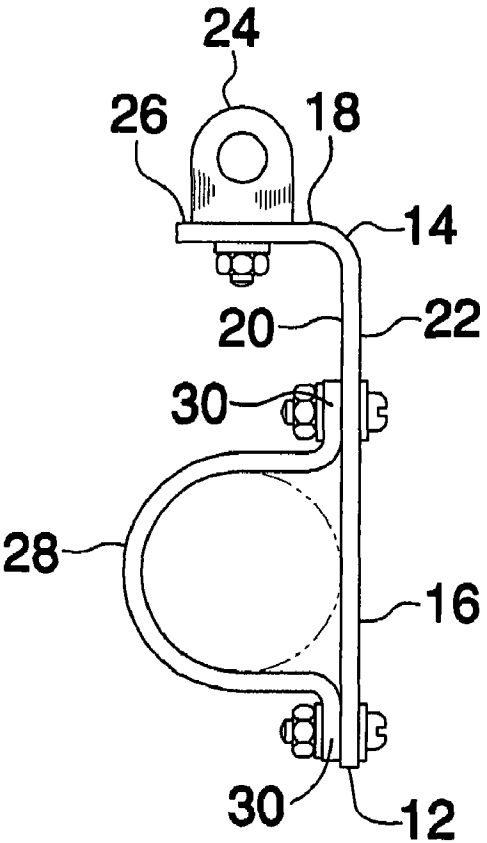
FIG. 3 is a rear view of a rear sight of the present invention.

With reference now to the drawings, and in particular to FIGS. 1 through 4 thereof, a new gun sight assembly embodying the principles and concepts of the present invention and generally designated by the reference numeral 10 will be described.

As best illustrated in FIGS. 1 through 4, the spear gun sight assembly 10 generally comprises a sight and bracket assembly to allow a person to attach a conventional bow sight to a spear gun 8. The assembly 10 includes a rear sight 11. The rear sight 11 comprises a first plate 12 that has a generally perpendicular bend 14 therein so that the first plate 12 includes a vertically orientated lower portion 16 and a horizontally orientated upper portion 18. The lower portion 16 has a first side 20 and a second side 22. A peep sight 24 is attached to and extends upwardly from a top side 26 of the upper portion 18. The peep sight 24 has a peephole extending therethrough. An axis of the peephole 24 is orientated parallel to a plane of the first side 20 of the lower portion 16 and parallel to a plane of the top side 26 of the upper portion 18.

A first coupler 28 is adapted for releasably securing the rear sight 11 to the spear gun 8 so that the axis of the peephole 24 is orientated parallel to a longitudinal axis of a spear 9 positioned in the spear gun 8. The first coupler 28 includes a semi-circular bracket that has a pair of ends each forming a flange 30. Each of the flanges 30 is removably attached to the first side 20 of the lower portion 16 with conventional fasteners so that a spear gun 8 may be held between the semi-circular bracket and the first plate 12.

A front sight 31 includes a second plate 32 that has an inner side 34 and an outer side 36. A loop 38 is attached to the second plate 32 so that the loop 38 extends away from the inner side 34. One or more sight pins 40 are attached to the second plate 32 and extend into the loop 38. The front sight 31 is of the type conventionally used for attaching to a bow.

A second coupler 42 is adapted for releasably securing the front sight 31 to the spear gun 8 so that the axis of the peephole 24 is aligned with the sight pin 40. The second coupler 42 includes a third plate 44 that has a first side 46 and a second side 48. The inner side 34 of the second plate 32 is attached to the second side 48 of the third plate 44 so that a plane of the second plate 32 is orientated parallel to a plane of the third plate 44. An arcuate bracket 50 has a pair of ends each forming a shoulder 52. Each of the shoulders 52 is removably attached to the first side 46 of the third plate 44 so that the spear gun 8 is removably held between the arcuate bracket 50 and the third plate 44.

In use, the first 28 and second 42 couplers are attached to a spear gun 8 as described above and as illustrated in FIG. 1. The first 28 and second 42 couplers allow a conventional bow sight to function as an aiming sight for the spear gun 8. These couplers also allow for variously sized spear guns and do not require fasteners that extend into the spear gun 8 for easy retrofitting.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sight assembly for removably positioning on a spear gun, said assembly comprising:

a rear sight including a first plate having a generally perpendicular bend therein such that said first plate includes a vertically orientated lower portion and a horizontally orientated upper portion, said lower portion having a first side and a second side, a peep sight being attached to and extending upwardly from a top side of said upper portion, said peep sight having a peephole extending therethrough;

a first coupler being adapted for releasably securing said rear sight to the spear gun;

a front sight including a second plate having an inner side and an outer side, a loop being attached to said second plate such that said loop extends away from said inner side, a sight pin being attached to said second plate and extending into said loop; and a second coupler being adapted for releasably securing said front sight to the spear gun such that said peephole is aligned with said sight pin.

2. The assembly according to claim 1, wherein an axis of said peephole is orientated parallel to a plane of said first side of said lower portion and parallel to a plane of said top side of said upper portion, said first coupler releasably securing said rear sight to the spear gun such that said axis of said peephole is orientated parallel to a longitudinal axis of a spear positioned in the spear gun.

3. The assembly according to claim 2, wherein said first coupler includes a semi-circular bracket having a pair of ends each forming a flange, each of said flanges being removably attached to said first side of said lower portion such that the spear gun is held between the semi-circular bracket and said first plate.

4. The assembly according to claim 2, wherein said second coupler includes a third plate having a first side and a second side, said inner side of said second plate being attached to said second side of said third plate such that a plane of said second plate is orientated parallel to a plane of said third plate, an arcuate bracket having a pair of ends each forming a shoulder, each of said shoulders being removably attached to said first side of said third plate such that the spear gun is held between the arcuate bracket and said third plate.

5. A sight assembly for removably positioning on a spear gun, said assembly comprising:

a rear sight including a first plate having a generally perpendicular bend therein such that said first plate includes a vertically orientated lower portion and a horizontally orientated upper portion, said lower portion having a first side and a second side, a peep sight being attached to and extending upwardly from a top side of said upper portion, said peep sight having a peephole extending therethrough, an axis of said peephole being orientated parallel to a plane of said first side of said lower portion and parallel to a plane of said top side of said upper portion;

a first coupler being adapted for releasably securing said rear sight to the spear gun such that said axis of said peephole is orientated parallel to a longitudinal axis of a spear positioned in the spear gun, said first coupler including a semi-circular bracket having a pair of ends each forming a flange, each of said flanges being removably attached to said first side of said lower portion such that the spear gun is held between the semi-circular bracket and said first plate;

a front sight including a second plate having an inner side and an outer side, a loop being attached to said second plate such that said loop extends away from said inner side, a sight pin being attached to said second plate and extending into said loop; and a second coupler being adapted for releasably securing said front sight to the spear gun such that said axis of said peephole is aligned with said sight pin, said second coupler including a third plate having a first side and a second side, said inner side of said second plate being attached to said second side of said third plate such that a plane of said second plate is orientated parallel to a plane of said third plate, an arcuate bracket having a pair of ends each forming a shoulder, each of said shoulders being removably attached to said first side of said third plate such that the spear gun is held between the arcuate bracket and said third plate.

* * * * *